United States Patent [19]

Suter

[11] 4,036,444

[45] July 19, 1977

[54] APPARATUS FOR PNEUMATICALLY SEPARATING A FOOT LAP FROM A SPINNING COP

[75] Inventor: Xaver Suter, Thalwil, Switzerland

[73] Assignee: Maschinenfabrik Schweiter AG, Horgen, Switzerland

[21] Appl. No.: 697,943

[22] Filed: June 21, 1976

[30] Foreign Application Priority Data

July 3, 1975 Switzerland ..... 8685/75

[51] Int. Cl.[2] ..... B65H 67/08; B65H 54/22

[52] U.S. Cl. ..... 242/35.6 E

[58] Field of Search ..... 242/35.6 E, 35.6 R, 242/35.5 R, 35.5 A

[56] References Cited

U.S. PATENT DOCUMENTS

| | | | |
|---|---|---|---|
| 2,755,857 | 7/1956 | Furst | 242/35.6 E X |
| 3,059,866 | 10/1962 | Reiners | 242/35.6 E |
| 3,295,776 | 1/1967 | Cruickshank et al. | 242/35.6 E UX |
| 3,329,362 | 7/1967 | Kieronski | 242/35.6 E UX |
| 3,355,118 | 11/1967 | Kupper | 242/35.6 E |
| 3,373,948 | 3/1968 | Raasch | 242/35.6 E |
| 3,406,920 | 10/1968 | Kamp | 242/35.6 E |
| 3,471,101 | 10/1969 | Moyer et al. | 242/35.6 R |
| 3,608,843 | 9/1971 | Siedlich | 242/35.6 E |

*Primary Examiner*—Stanley N. Gilreath
*Attorney, Agent, or Firm*—Flynn & Frishauf

[57] ABSTRACT

A housing structure is formed with a suction connection to which pneumatic suction is applied, the suction connection internally terminating in a nozzle which surrounds a rotatable centering cone. The support for the spinning cop, externally of the nozzle, is ring-shaped. A thread drawn out by suction through the nozzle past the ring-shaped support can be clamped against the lower surface thereof upon axial movement of a clamping element for a first distance, complete movement of the clamping element then clamping a further portion of the drawn-off thread against a second clamping surface so that the thread will be taut, and placed in interfering position with a knife edge which cuts the thread at a predetermined point to ensure severing of the drawn-off thread. To provide for a long foot lap, the cop can be lifted repeatedly off the support surface after the thread has been first clamped so that thread is unwound therefrom.

10 Claims, 8 Drawing Figures

APPARATUS FOR PNEUMATICALLY SEPARATING A FOOT LAP FROM A SPINNING COP

CROSS REFERENCE TO RELATED PATENTS AND APPLICATIONS

U.S. Pat. No. 3,380,677, Stapfer; U.S. Pat. No. 3,608,843, Siedlich; U.S. application Ser. 308,875, filed Nov. 8, 1972, Heckel abandoned in favor of continuation U.S. application Ser. No. 707,348 filed July 21, 1976; U.S. application Ser. 697,944, filed June 21, 1976, Suter, all assigned to the assignee of the present application.

The present invention relates to automatic winding machines, and more particularly to apparatus for pneumatically removing the foot lap from spinning cops.

It has previously been proposed — see German Patent DT-PS 1,922,879, to which cross referenced U.S. Pat. 3,608,843 corresponds, assigned to the assignee of the present application — to utilize a suction tube which has an inner diameter which approximately fits around the foot end of the spinning cop and has a conically decreasing diameter. The suction tube is closed off by a bottom which is flat, matching the diameter of the foot end of the form of the spinning cop, the closure having a nozzle-like opening leading to the suction connection, the opening being arranged essentially along the outer diameter of the bottom closure.

The apparatus permits removal of the foot lap with great reliability. It cooperates with a support and gripper arrangement which, among other uses, is employed to speed removal of the foot lap by repetitively lifting the spinning cop off the suction opening, so that the foot lap is picked off the winding form of the cop. To prevent the foot lap from being drawn along upon movement of the spinning cop with respect to the suction nozzle closure, the foot lap is temporarily held by a blunt back side of a severing knife against the respective edge of the suction opening, the foot lap being picked off by the spinning cop form by short oscillatory motion of the gripper arrangement together with the spinning cop.

It has been found from experience that it is difficult to reliably clamp the initially sucked-off foot lap to permit picking thereof; and further to reliably cut the foot lap by cutter arrangements which are reliably effective over a long period of time.

It is an object of the present invention to provide apparatus for pneumatically removing the foot lap from spinning cops which reliably clamps the foot lap to permit picking thereof off the winding form of the spinning cop and to reliably cut the foot lap regardless of wear of the cutting element.

SUBJECT MATTER OF THE PRESENT INVENTION

Briefly, a housing is formed with a centering element, such as a cone, in the vicinity of which terminates a suction opening. The centering cone is rotatable with rotation of the spinning cop. Two clamping positions for a foot lap sucked off by suction by the nozzle are provided. Preferably, the housing is so located that the spinning cop can be placed vertically thereon. The first clamping position is beneath the spinning cop, for example formed by the edge of a support surface adjacent the nozzle, and by a movable clampling element which can clamp the foot lap against the undersurface of the support for the spinning cop. Located axially downwardly is a second clamping position formed as surface arranged in the housing against which a second clamping element can be moved. Movement of the clamping elements is controlled, for example, by a push rod operated by a cam. The first and second clamping positions are relatively rotatable with respect to each other and are operated sequentially, so that the foot lap is first clamped in the first clamping position and then, under the influence of suction, held tight against the second clamping position. The cutter is located in interfering position with respect to a straight line between the two clamping positions so that it will engage the tightly stretched thread, as clamped, and thus reliably sever the thread.

The thread is reliably held in position and can be severed even though the cutter element itself has been dulled by long use. Additionally, clamping the thread in this manner permits relative movement between the spinning cop and the first clamping position so that the foot lap can be picked off the spinning cop and will have the required length. Relative rotation of the first clamping position with respect to the second clamping position, and the sequential engagement provide for tight stretching of the thread between the clamping positions, so that severing will reliably be effected. The sharpness of the cutting edge will then only govern the smoothness of the cut, but not whether the foot lap is severed at all or not.

The arrangement provides for a driven surface on which the spinning cop is located. The cop, therefore, will receive a rotary impulse each time when it engages the support surface on the nozzle. Thus, drive means for the cops themselves and arranged on its suppport and gripper apparatus for the other end of the cop, therefore, need not be provided, thus substantially reducing the complexity of the system both from a constructional and from a control point of view.

The invention will be described by way of example with reference to the accompanying drawings, wherein.

Figure 1:
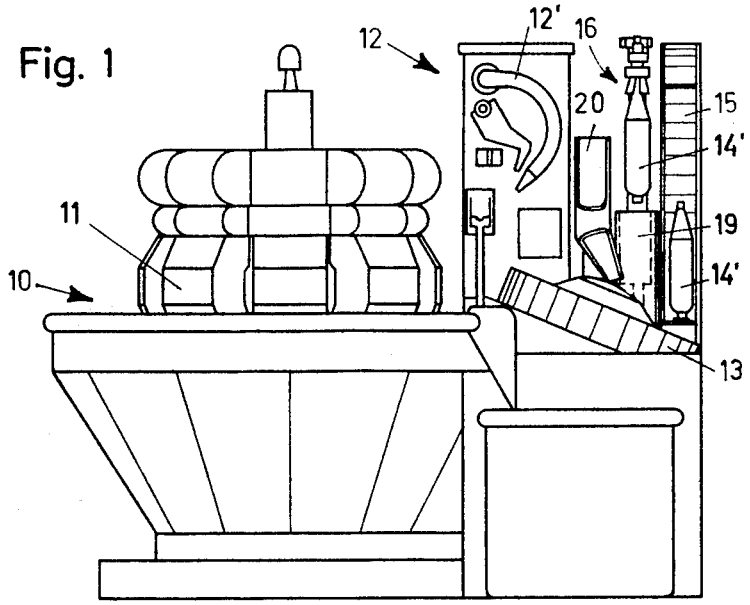
FIG. 1 is a highly schematic side view of an automatic cross winding machine having an arrangement for pneumatic removal of the foot lap of spinning cops.
Figure 2:
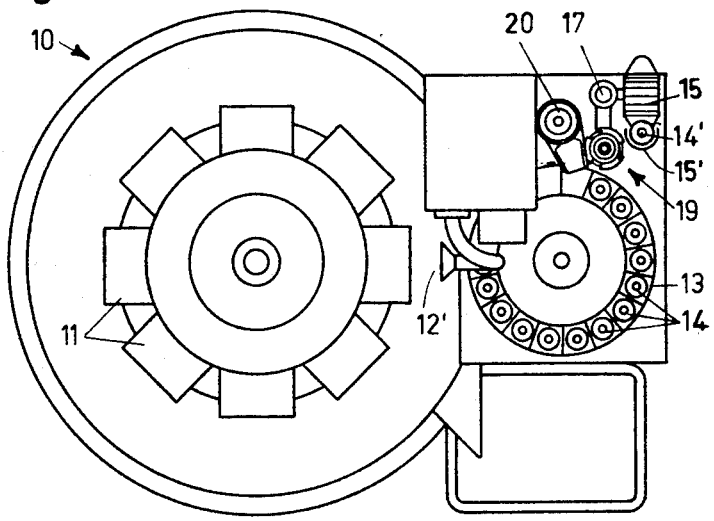
FIG. 2 is a schematic top view of the machine of FIG. 1.
Figure 3:
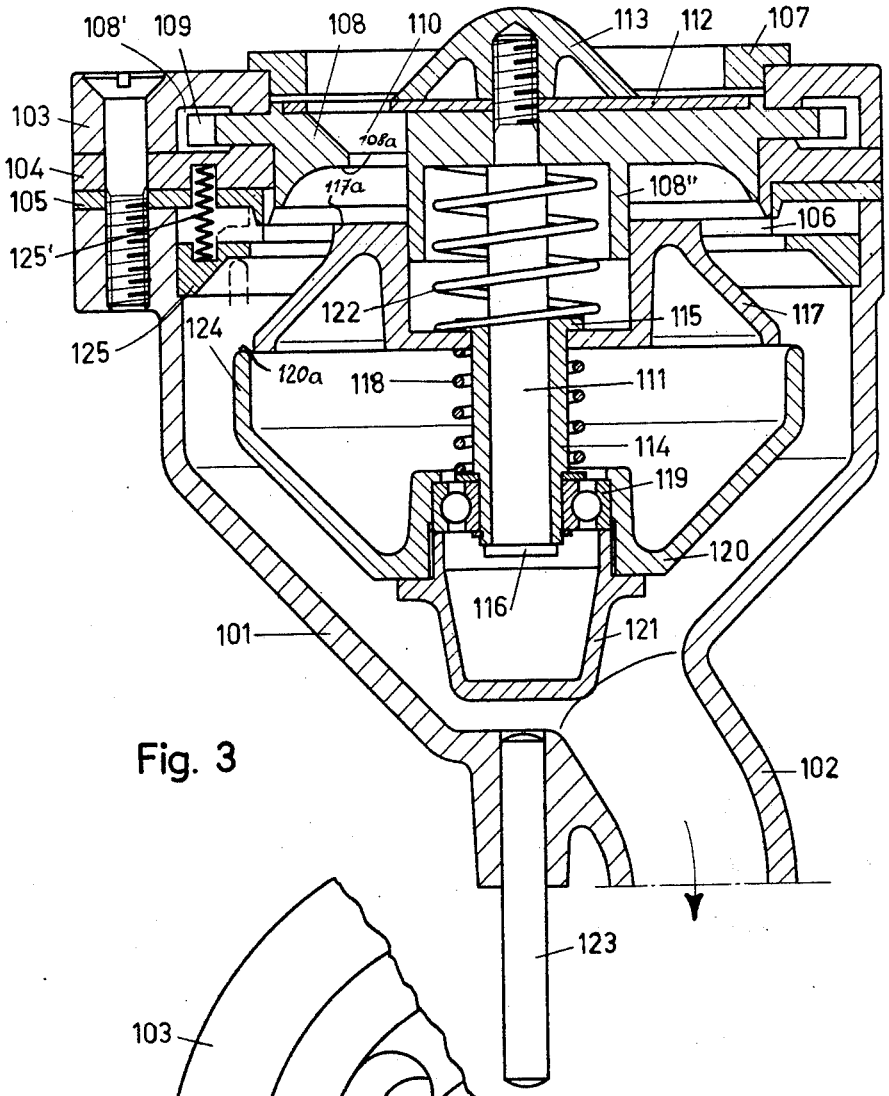
FIG. 3 is a longitudinal cross-sectional view, to a greatly enlarged scale, of the pneumatic arrangement to remove the foot lap, with a spinning cop removed.
Figure 4:
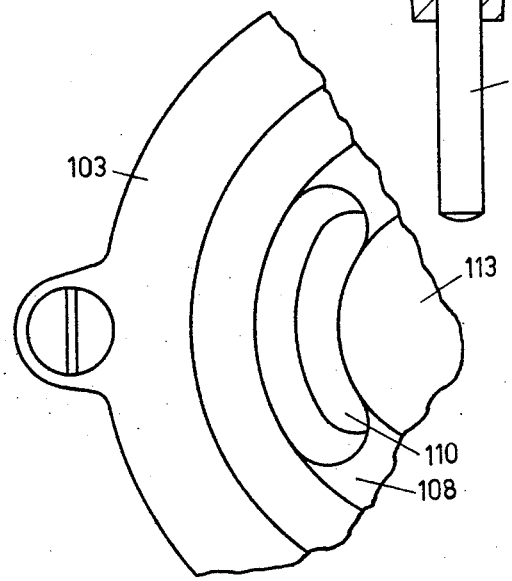
FIG. 4 is a fragmentary top view of the arrangement of FIG. 3.

The automatic winding machine illustrated in FIGS. 1 and 2 is a cross winding machine, for example of the cone winding type. A plurality of winding stations 11 are arranged, as well known, on the periphery of a rotary table 10. Each of the winding stations 11 have a bottom portion which includes means (not shown) to receive a winding cop to be wound on cones at the respective winding stations 11. When the winding cops are empty, a new winding cop can be inserted for continued winding of the cone, which will have a thread length substantially in excess of the thread length of a specific cone thereon. Automatic interchange of empty cops with full ones is effected by rotation of the table 10 to associate the respective winding position 11 with an interruption clearing mechanism 12.

The interruption removal mechanism 12 includes a magazine 13, which can rotate in indexing steps. Spinning cops 14, suitably prepared and having end laps or foot laps, are located in the magazine 13. A suction nozzle is placed at location 12' to receive the thread from the cone being wound and to be knotted, after interchange of the empty spinning cop for a new one, with the foot lap of the new spinning cop. The knotting apparatus is known and is not specifically shown in the drawings.

Spinning cones 14' are removed from a storage bin, not specifically shown, and separately transported by a cop conveyor 15, forming part of the interruption clearing mechanism 12 to a removal station 15'. At the removal station 15', a particular individual cop 14' is gripped by a gripper 16. Gripper 16 can rotate about a shaft 17 (FIGS. 5, 6) to transport the cop to a cop insertion or placement station 20, essentially in form of a chute to direct the cop into an empty receiving position of the magazine 13. The gripper 16 and the foot lap removal apparatus, together, generally form a cop preparation station 19. The present invention is specifically concerned with the cop preparation station 19, the details of the structure and operation of which will now be described in connection with FIGS. 3 to 8.

The cop preparation station (FIGS. 3 and 4) to pneumatically remove the foot lap from a spinning cop 14' has a housing 101 (FIGS. 3, 5, 6) which, at its lower end, is provided with a suction air tube connection 102. A knife holder 104 secures a knife carrier 105 in which a ring-shaped blade 106 is clamped (see FIGS. 7, 8). The ring flange 103 supports, at its upper end, a centering ring 107 which facilitates centering of a spinning cop introduced to the end face of the apparatus.

A ring groove 108' is formed within the flange 103 to rotatably receive a wind-off ring 108. Wind-off ring 108 is formed at its outer circumference with a gear 109, exposed through an opening in the housing 101 (not shown) to be engageable with a suitable drive mechanism, such as an externally driven drive pinion, not shown.

The wind-off ring 108 is formed with an essentially kidney-shaped aperture 110; the outer radius of the aperture 110 corresponds approximately to the inner diameter of the centering ring 107. Air is sucked through this aperture 110 through tube connection 102. A shutter 112, with an opening therein, covers the wind-off ring 108 towards the upper side. The shutter 112 carries a cop-centering cone 113 at its upper side; its lower side is secured to a shaft 111. Preferably, shaft 111, the ring 108, the aperture ring 112 and the centering cone 113 are connected by being screwed together to form a single rotational unit driven, as above noted, by engagement of the gear surface 109 with a driven pinion.

Ring 108 has a lower extension 108'' which surrounds the shaft 111 with clearance. The extension 108'', formed as a cylindrical projection, is surrounded by a bell 117. Bell 117 is rotatable as well as axially movable with respect to the cylindrical extension 108''. Upon axial movement of bell 117, the upper flat surface **117*a* of the bell can be pressed against the lower flat surface 108*a* of the ring 108. When so engaged, the bell 117 will be carried along to rotate with the ring 108. To permit rotation and axial movement of the bell 117, a sleeve 114 surrounds shaft 111. Sleeve 114 is axially slidable with respect to the shaft 111; its lower outer surface carries a ball bearing 119. Sleeve 114 has a collar 115 at its upper side bearing with the lower surface thereof against the upper inturned surface of bell 117. In effect, sleeve 114 is suspended with its collar 115 at the inner end of the bell 117 and, in its normal and rest position seats with its lower end on an end collar 116 formed on shaft 111. Additionally, sleeve 114 is connected through the ball bearing 19 with a counter bell 120. The counter bell 120 has a larger maximum diameter so that, upon relative slight movement, it can engage around the outer surface of bell 117. Ball bearing 119 permits relative rotational movement between the sleeve 114 and the counter bell 120. A dome-shaped actuating member 121 is located to engage the counter bell 120 and positioned to be, in turn, engaged by a control rod 123 located in the bottom portion of the housing 121. Upon upward movement of rod 123, the dome-shaped actuating member 121 can move counter bell 120 to the position shown in dotted lines at the left side of FIG. 3 to engage the lower surface of a clamping ring 125. The clamping ring 125 is elastically supported by means of springs 125' from the blade holder ring and clamp 104, 105. Clamping ring 125 can be pressed upwardly as shown in dashed lines in FIG. 3.**

The relative position of the parts are maintained when at rest or, rather, in the absence of a cone, by springs 118, 122. Spring 118 is located around sleeve 114 to bear, on the one hand, on the flange formed by the innner race of ball bearing 119 and, on the other, against the lower surface of bell 117. This spring will press bell 117 against the upper collar 115 of the sleeve 114. The other spring 122 surrounds shaft 111 in the region of the cylindrical extension 108'' of the wind-off ring 108. It is provided to separate the wind-off ring 108 and bell 117 in axial direction. As will be explained below in connection with the operation, spring 118 must be stronger than the spring 122 so that, when the actuating rod is moved upwardly, sequential lifting of, first, the counter bell 120 and bell 117 against the force of spring 122 will result. Thus, as the first operation, the upper facing surface **117*a* will engage the lower surface 108*a* of the wind-off ring 108. Subsequent, further movement of the actuating rod 123 will only then cause relative axial shifting between the sleeve 114 and shaft 111 counter the force of spring 118, and thus axial relative shifting between the bell 117 and the counter bell 120 in order to engage the edge 124 of the counter bell 120 with the clamping ring 125 for engagement with the knife holder clamp 104, 105.**

The cop preparation station 19 is brought in operative association with a cop 14', for removal of a foot lap therefrom, by cooperation with grippers 16 (FIGS. 1, 2, 5, 6). Grippers 16 are rotatable about shaft 17.

Figure 5:
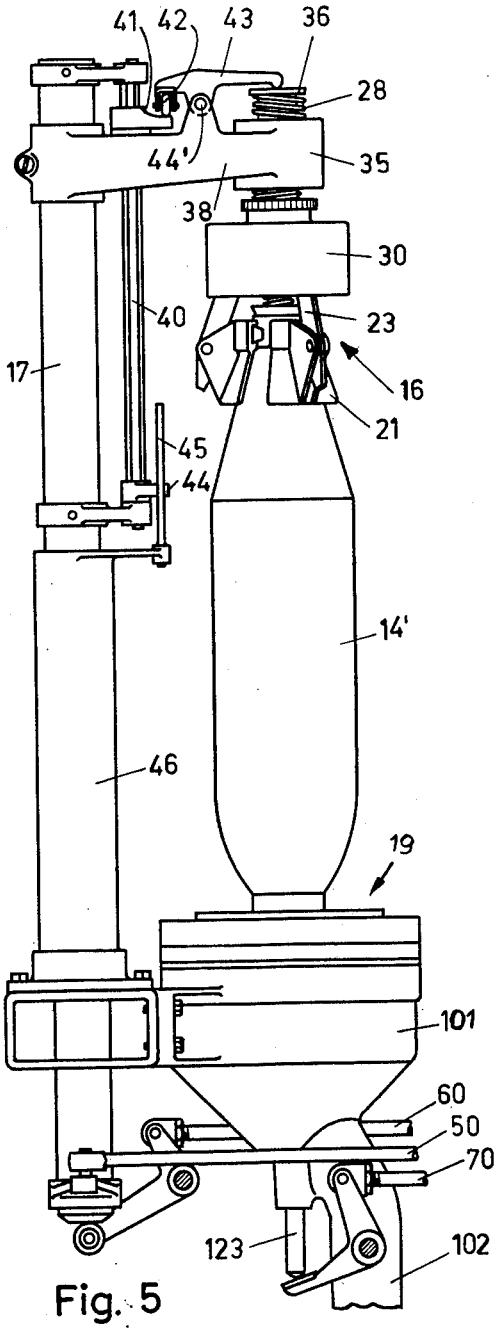
FIGS. 5 and 6 are schematic side views of the foot lap removal mechanism including the holding arrangement for a spinning cop, in two positions of the spinning cop.
Figure 6:
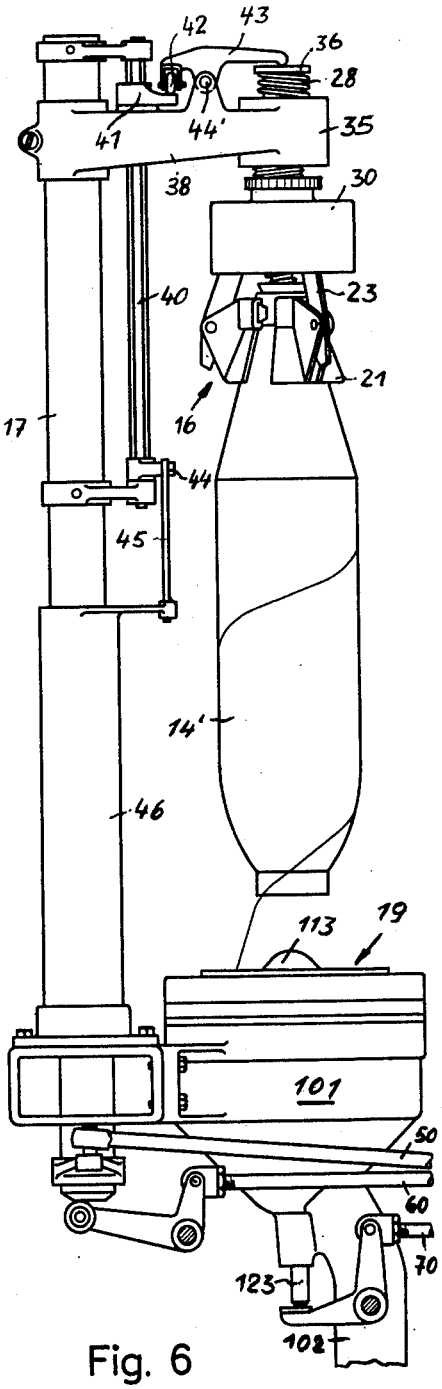

FIGS. 5 and 6 illustrate the arrangement in two operating positions.

The cop preparation station 19 is secured to a machine frame 46 which also carries shaft 17. Shaft 17 provides for rotary movement of the gripper 16 above the station 19. The cop gripper 16 usually includes three gripping or clamping jaws 21 in order to clamp a cop 14' at the end which is opposite that from which the foot lap is taken off. The details are shown in cross referenced application Ser. No. 697,944. The jaws 21 are secured in a bell 30 by links 23. A ball bearing 35 secures the bell 30 to the free end of a cross arm 38 which is secured to shaft 17.

A rotatable switching spindle 40 is located parallel to the shaft 17. Switching spindle 40 carries a camming disk 41 at its upper end. Camming disk 41 cooperates with a cam follower roller 42 secured to one end of a double-armed lever 43. Lever 43 can tip about a fulcrum shaft 44', secured to the cross arm 38. The other end of the lever 43 engages a flange 36 secured to the end of a pin 28 which operates the grippers 16. The connection is so made that, when the lever 43 is rotated in clockwise direction, it pushes against rod 28 to deflect the grippers 16 outwardly against the force of a restoring spring; thus, downward pressure on rod 28 will spread the gripper jaws.

The switching spindle 40 and the camming disk 41 secured thereto are rotated by means of a cam element 44 which, upon rotation of the shaft 17 and hence movement of spindle 40, engages against stop rods 45 secured to the machine frame 46. Only one stop rod 45 is shown in the drawings.

Rotation of spindle 17 which permits the grippers 16 to move through an angular range between the delivery station 15' of the cop transport system 15 and the cop preparation station 19 or the magazine filling station 20 (FIG. 2), respectively, is controlled by linkage 50. Axial movement, up or down (FIGS. 5, 6) of the shaft 17 is controlled by linkages 60. Further link elements 70 operate the rod 123 of the cop preparation station 19. The respective links or rods 50, 60, 70 are suitably controlled by control elements, not shown, for example a cam disk, which is synchronized with operation of the automatic clearing mechanism 12.

Cops 14' are received by the clamps or grippers 16 from the cop transport system 15 (FIG. 1) at the receiving position 15'. The receiving position 15' is adjacent the cop preparation position, as clearly seen in the top view of FIG. 2. Swinging movement of the arm 38 will then place the cop 14' in alignment with and over the cop preparation station 19. The necessary axial up-and-down movement of the shaft 17 carrying the grippers is controlled by linkage rod 60; linkage rod 50 controls rotary movement of the shaft 17 and hence the grippers or clamps 16. The links 50, 60, 70 may be controlled, for example, by a shaft which has suitable control cams located thereon to control sequential operation for the various operating phases of the spinning cop, that is, for the individual movement of a spinning cop through the swinging arc of the shaft 17 as well as for the preparation thereof. The shaft with the control cams may well rotate through 360°.

Operation: To remove the foot lap from a spinning cop 14, it is first gripped, and moved to fit over the centering cone 113 of the cop preparation station. The position of the cop will be as in FIG. 5. The centering cone 113 (FIGS. 4, 7, 8) rotates together with the wind-off ring 108. As soon as the cop engages the centering cone, it will spin with it; this spinning movement is possible since the grippers 16 are journalled in ball bearing 35 (FIGS. 5, 6). Suction through the aperture 110 will affect the winding lap and suck the end lap into the housing 101. Pull-off of the thread is facilitated if the direction of rotation of the cop is counter the winding direction of the windings thereon.

Figure 7:
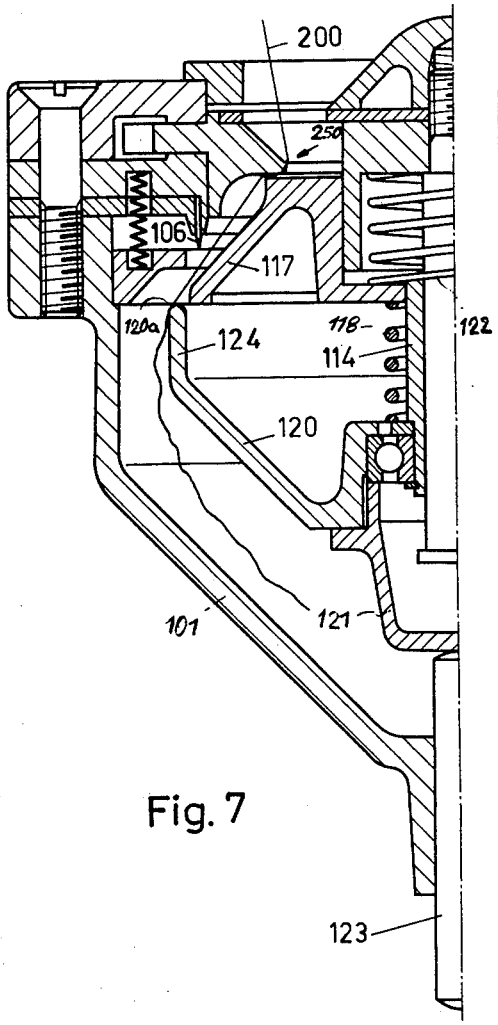
FIGS. 7 and 8 are fragmentary half-sectional views similar to FIG. 3 and showing the sequential positions of the apparatus as well as the thread being severed to illustrate the mode of operation.

The initial suction phase is relatively short. During this time, the control rods 70 (FIGS. 5, 6) will operate the actuating rod 123 (FIGS. 4, 7, 8) to the extent illustrated in FIG. 7 until, and as seen in FIG. 7, the upper clamping surface **117*a* of bell 117 engages the lower clamping surface 108*a* of the wind-off ring 108. The end of the thread 200 which is sucked downwardly by the suction through stub 102 is thus pinched or clamped at a first clamping position 250 (FIG. 7). Concurrent with, or immediately after clamping of the thread end 200 at clamping position 250, cop 14' is lifted suddenly and rapidly to assume the position shown in FIG. 6**. This results in relative movement between the clamped end of the thread and the cop in a direction counter the winding direction of the cop so that the end of the thread will wind off the cop to some extent.

The above-described sequence is repeated several times in quick succession so that the foot lap is plucked or picked off to provide for reliable removal of the foot lap from the cop.

Figure 8:
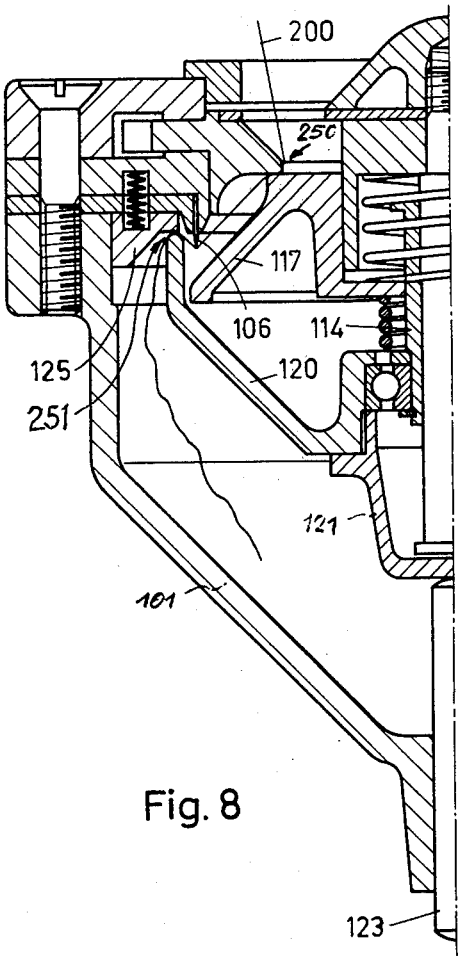

The last upward movement of the cop 14', which may be continued to the upper end position, will result in pull-off of a foot lap of such length that it can be used for subsequent handling of the cop and the foot lap. The rod 70 will, at that time, push actuating rod 123 upwardly to its upper end position, and beyond its first shorter stroke. Further penetration of the rod 123 into the housing 101 will cause counter bell 120 to engage with its upper edge 124 against the clamping ring 125, as seen in FIG. 8. The thread is now clamped at a second, and lower position 25. The second clamping position is fixed, that is, does not rotate with respect to the housing 101. As clearly seen in FIG. 8, the thread is pressed against the blade band or ribbon 106 and is thus cut off.

The blade band or strip 106 need not be very sharp in order to reliably sever the thread; the relative movement between the two clamping positions for the thread will result in high tension on the thread. This tension may be so high that the thread would tear anyway by itself, the blade practically determining only the position where the thread will tear. The blade additionally avoids fraying of the severed end of the thread.

After the thread has been cut or severed, the actuating rod 123 moves downwardly, thus releasing both clamping positions. The gripper 16 is then controlled to move the cop 14' to its upper position and to swing laterally to move the cop with the severed foot lap to the filling station 20 (FIGS. 1, 2).

The upper end surface of the centering ring 107 may form the bottom wall of the construction explained in U.S. Pat. No. 3,608,843, assigned to the assignee of the present application.

Various changes and modifications may be made within the scope of the inventive concept.

I claim:

1. Apparatus for pneumatically separating a foot lap from spinning cops (14') for use in automatic winding machines, comprising a housing (101, 103, 104) having a longitudinal axis and formed with a suction connection (102) to which pneumatic suction is applied;

a suction nozzle terminating the suction connection in the housing including a rotating centering cone (113) and a cone support element (108) having an upper surface (112) facing the spinning cop (14') and being formed with a nozzle opening (110) communicating with the suction connection (102);

means forming a first clamping position (250) for thread (200) sucked from the spinning cop (14') located beneath the upper surface (112) including means forming a first clamping surface (108*a*) located beneath the upper surface (112) and rotatable therewith;

a rotatable first clamping element (117) having a second clamping surface (117*a*) cooperating with the first clamping surface (108*a*);

means (123, 119, 118) effecting relative axial movement of said first clamping position forming means and said first clamping element (117) to engage said first and second clamping surfaces (108*a*, 117*a*) upon such axial movement and pinch a sucked-off thread (200) therebetween;

means forming a second clamping position (251) for thread (200) sucked from the spinning copy (14') located axially beneath said first clamping position (250) and having means (125) forming a third clamping surface;

a second clamping element (120) having a fourth clamping surface (120*a*) cooperating with the third clamping surface;

operating means (123, 121) effecting relative axial movement of said third clamping surface forming means (125) and said second clamping element (120) to engage said third and fourth clamping surface and pinch a sucked-off thread (200) therebetween;

said operating means (123, 121) being operable sequentially with respect to said means forming the second clamping position to stretch a sucked-off thread essentially taut between said first and second clamping positions (250, 251);

and cutter means (106) located in interfering position with respect to an imaginary straight surface between said clamping positions to sever a thread (200) clamped between said clamping positions (250, 251).

2. Apparatus according to claim 1, wherein the means forming the second clamping position (251) are fixed in the housing (101) so that thread (200) clamped in the first clamping position (250) and in the second clamping position (251) will be stretched taut due to relative rotation of the respective clamping positions.

3. Apparatus according to claim 1, further comprising positioning means (16, 17, 21, 23, 28, 30, 35, 36, 41, 42, 43) engageable with a spinning cop and located to place a spinning cop (14') on the rotating centering cone (113);

and means (60, 17) coupled to the positioning means controlling movement of the positioning means to lower the spinning cop (14') on the centering cone, and subsequently, sequentially, cyclically lift the spinning cop (14') off the centering cone for repeated, cyclical engagement and disengagement of the spinning cop with the rotating centering cone to intermittently impart rotation thereto by frictional engagement therewith.

4. Apparatus according to claim 3, wherein the direction of rotation of the centering cone is the winding direction of thread on the spinning cop.

5. Apparatus according to claim 1, further comprising gear means (109) operatively connected with the rotating centering cone (113) to rotate said centering cone.

6. Apparatus according to claim 5, wherein said gear means (109) comprises a gear formed on the cone support element (108).

7. Apparatus according to claim 1, further comprising a center shaft (111) secured to the centering cone (113);

the rotatable first clamping element (117) comprises an upwardly open bell formed with the second clamping surface (117*a*) thereon facing the first clamping surface (108*a*) and axially movable with respect to the shaft (111);

and the second clamping element (120) comprises a second bell open in an upward direction and formed with the fourth clamping surface (120*a*) to provide the second clamping position (251).

8. Apparatus according to claim 7, further comprising a spring (122) holding the first bell (117) separated from the means forming the first clamping position (250) to hold the first clamping position (250) open, unless placed in clamping position by said operating means (123);

and a second spring (118) separating the second bell (120) and the first ball (117) to hold the second clamping position (251) in open state unless closed by said operating means (123);

and wherein the first spring (122) is weaker than the second spring (118).

9. Apparatus according to claim 7, wherein the second bell (120) is shaped and positioned to surround the first bell (117) upon relative movement between said bells (117, 120).

10. Apparatus according to claim 7, wherein the operating means comprises an operating rod (123) movable over a first position effecting clamping of the first clamping position (250) and additionally movable to a second further position for subsequent engagement of the second clamping position (251); the first relative movement of the operating means relatively moving the first bell (117) and the means forming the first clamping position, and the subsequent movement moving the second bell (120) relatively to the first bell (117).

* * * * *

UNITED STATES PATENT AND TRADEMARK OFFICE

CERTIFICATE OF CORRECTION

PATENT NO. : 4,036,444

DATED : July 19, 1977

INVENTOR(S) : Xaver SUTER

It is certified that error appears in the above-identified patent and that said Letters Patent are hereby corrected as shown below:

last page, first column, line 24 should read
-- clamping surfaces -- last page, second column, line 6 should read
-- centering cone is counter the winding --

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*